United States Patent [19]

Mammen et al.

[11] Patent Number: 4,592,553

[45] Date of Patent: Jun. 3, 1986

[54] MATRIX CATEGORY GAME

[76] Inventors: William R. Mammen, 203 East Hill Rd., Lebanon Township, Hunterdon County; Joseph P. Pietrowsky, 39 Clayton St., Hillsdale Borough, both of N.J.

[21] Appl. No.: 686,469

[22] Filed: Dec. 26, 1984

[51] Int. Cl.[4] ..... A63F 3/00

[52] U.S. Cl. ..... 273/240; 273/272

[58] Field of Search ..... 273/272, 240, 236, 248, 273/1 R, 265; 434/170, 172, 208, 403, 207

[56] References Cited

U.S. PATENT DOCUMENTS

| | | | |
|---|---|---|---|
| 2,380,106 | 7/1945 | Hilton | 273/272 |
| 3,393,914 | 7/1968 | Hill | 273/272 |
| 3,413,004 | 11/1968 | Smith | 273/269 |
| 4,123,051 | 10/1978 | Tsacoyannis | 273/1 R |
| 4,222,561 | 9/1980 | Whitten | 273/1 R |
| 4,306,724 | 12/1981 | Brzezinski | 273/272 X |
| 4,341,387 | 7/1982 | Freyman | 273/240 |

OTHER PUBLICATIONS

"The Kennedy Game", Sunday Star, This Week magazine, Apr. 19, 1964, pp. 4 & 5.

*Primary Examiner*—Richard C. Pinkham
*Assistant Examiner*—Matthew L. Schneider
*Attorney, Agent, or Firm*—Kenneth P. Glynn

[57] ABSTRACT

The present invention is directed to a matrix category game which includes an apparatus for playing as well as a method of playing. The apparatus includes a plurality of playing sheets having vertical columns and horizontal rows, each with a set of descriptive headings. At least one set of headings is color coded and the other is directed to various subject categories. A set of dice is included which has a letter of the alphabet on each facet and each die of which is color coded to correspond to the colors on the playing sheet. A writing instrument is provided for marking the playing sheet and instructions are included. Various subject categories are chosen from a list of categories and are inserted in one set of category headings. The dice are then rolled and the letter that faces upward on each one is written on the corresponding color descriptive heading. Each player must then write on a playing sheet an answer under each category and begins with the letter designated. A timer is used and the player who acquires the most points within the predetermined time wins the game.

12 Claims, 4 Drawing Figures

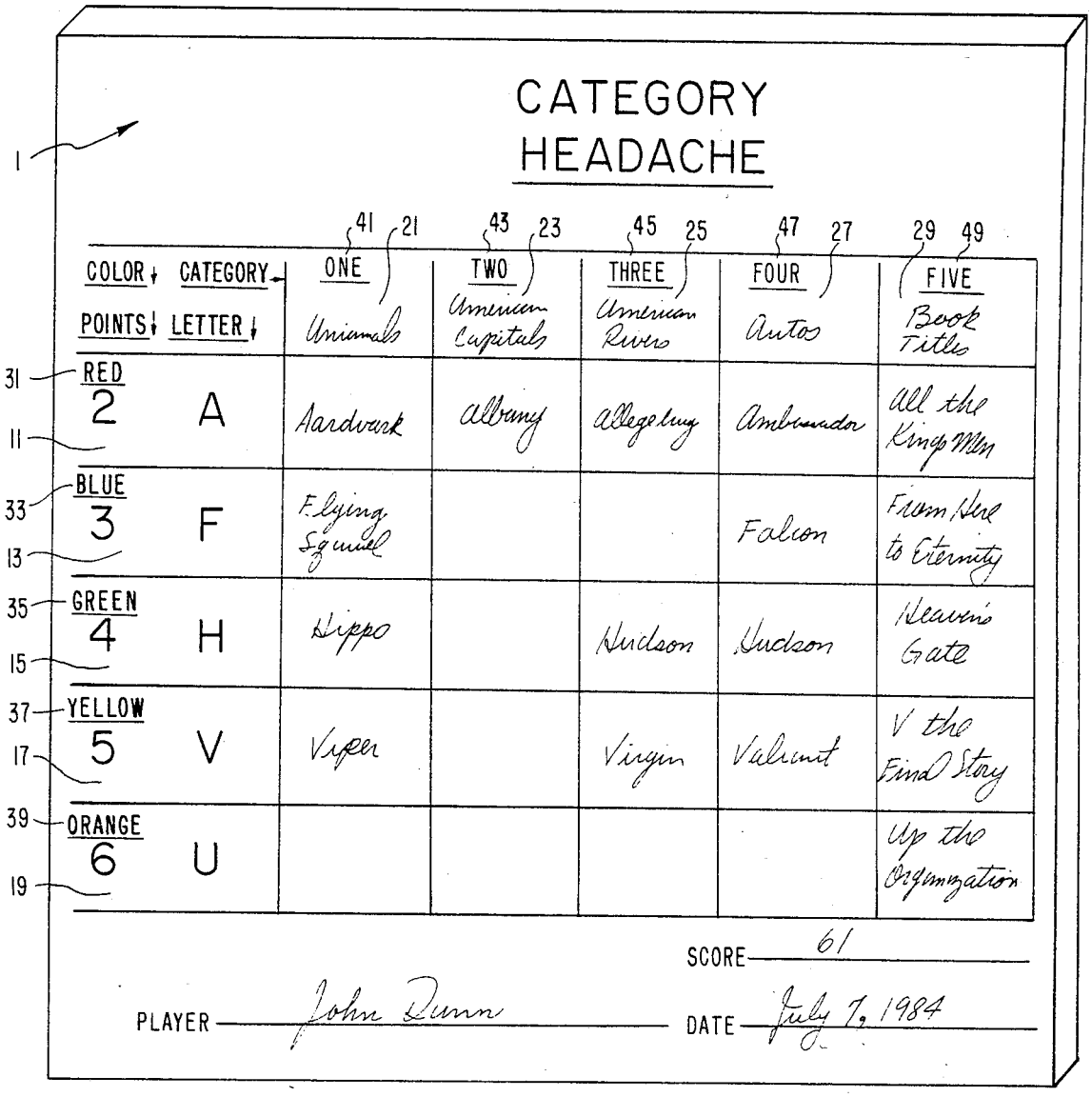

CATEGORY HEADACHE

| COLOR / POINTS | CATEGORY / LETTER | ONE (41, 21) | TWO (43, 23) | THREE (45, 25) | FOUR (47, 27) | FIVE (29, 49) |
|---|---|---|---|---|---|---|
| | | Animals | American Capitals | American Rivers | Autos | Book Titles |
| RED (31) 2 (11) | A | Aardvark | Albany | Allegheny | Ambassador | All the Kings Men |
| BLUE (33) 3 (13) | F | Flying Squirrel | | | Falcon | From Here to Eternity |
| GREEN (35) 4 (15) | H | Hippo | | Hudson | Hudson | Heaven's Gate |
| YELLOW (37) 5 (17) | V | Viper | | Virgin | Valiant | V the Final Story |
| ORANGE (39) 6 (19) | U | | | | | Up the Organization |

SCORE 61

PLAYER John Dunn DATE July 7, 1984

Figure 4

MATRIX CATEGORY GAME

BACKGROUND OF THE INVENTION

1. Field of the Invention

The present invention is directed to a matrix category game. More specifically, it is directed to a game played by two or more players which is based in part upon chance, in part upon strategy, and in part upon the information and intelligence which each player brings to the game. In particular, a category matrix is created by rows and columns on a playing sheet. Dice are rolled to determine letters of the alphabet and these letters along with selected categories form a matrix. Playing words which fit the selected categories must begin with these letters and must be written into the matrix within a given time. Scoring is based on the difficulty of the starting letters in addition to the number of playing words completed.

2. Prior Art Statement

Games using informational categories, many involving matrices, are known. These games are used with playing boards and the players are tested against one another with respect to how much information they know and/or how quickly they can answer questions in various categories. Thus, U.S. Pat. No. 3,633,914 involves a game apparatus using a master board which has columns designated by various countries around the world and rows designated by a variety of subject categories such as art, food and beverages, music, sports, etc. Information cards state names, places or things and the player must designate the country and the subject category to be entitled to cover a box on the playing board. Entire lines are completed to win.

U.S. Pat. No. 4,171,816 describes a game which teaches and rewards the players knowledge of grammatical or language concepts. Playing boards are used with figures of speech etc. U.S. Pat. No. 3,197,891 likewise involves a matrix type board game involving grammatical parts of speech. U.S. Pat. No. 3,413,004 describes a game apparatus which comprises playing boards having columns of letters and color coded letters for placement thereon. This involves the completion of words so as to create a fun game which may relate two words to each other as to their meaning and operates to teach children proper spelling. U.S. Pat. No. 4,043,560 is directed to a board game using playing tiles and color coded dice and involves a combination of skill and chance to acquire tiles having playing card suits.

Notwithstanding the above described prior art, there is no teaching of the present invention apparatus which involves a set of columns and a set of rows with one representing subject categories and the other representing colors and alphabet letters determined by chance rolling of dice. For this reason, the present invention is believed to be novel and unobvious.

SUMMARY OF THE INVENTION

The present invention is directed to a matrix category game which includes an apparatus for playing as well as a method of playing. The apparatus includes a plurality of playing sheets having vertical columns and horizontal rows, each with a set of descriptive headings. At least one set of headings is color coded and the other is directed to various subject categories. A set of dice is included which has a letter of the alphabet on each facet of each die. Each die is color coded to correspond to the colors on the playing sheet. Means is provided for marking the playing sheet and instructions are included. Various subject categories are chosen from a list of categories and are inserted in one set of category headings. The dice are then rolled and the letter that faces upward on each one is written on the corresponding color descriptive heading. Each player must then write on a playing sheet an answer under each category that begins with the letter designated. A timer is used and the player who acquires the most points within the predetermined time wins the game.

BRIEF DESCRIPTION OF THE DRAWINGS

FIG. 4 shows the playing sheet of FIG. 1 which has been filled in by a player.

DETAILED DESCRIPTION OF THE INVENTION AND DRAWINGS

An object of the present invention category matrix game is to provide a game which involves a combination of knowledge and of chance and which will inherently and indirectly enable players to learn from one another. Another object of the present invention is to provide a game with appeal to an extremely broad spectrum of players with various educational, social and intellectual capabilities and experiences.

Another object of the present invention is to provide a game involving categories of subjects which may be used among all ages of players capable of writing or at least identifying specific examples within given categories.

Another object is to provide a convenient yet relatively inexpensive game which may be easily transported anywhere.

Another object of the present invention is to provide a game which may be used in schools to teach subjects such as history, geography, biology and even chemistry.

Figure 1:
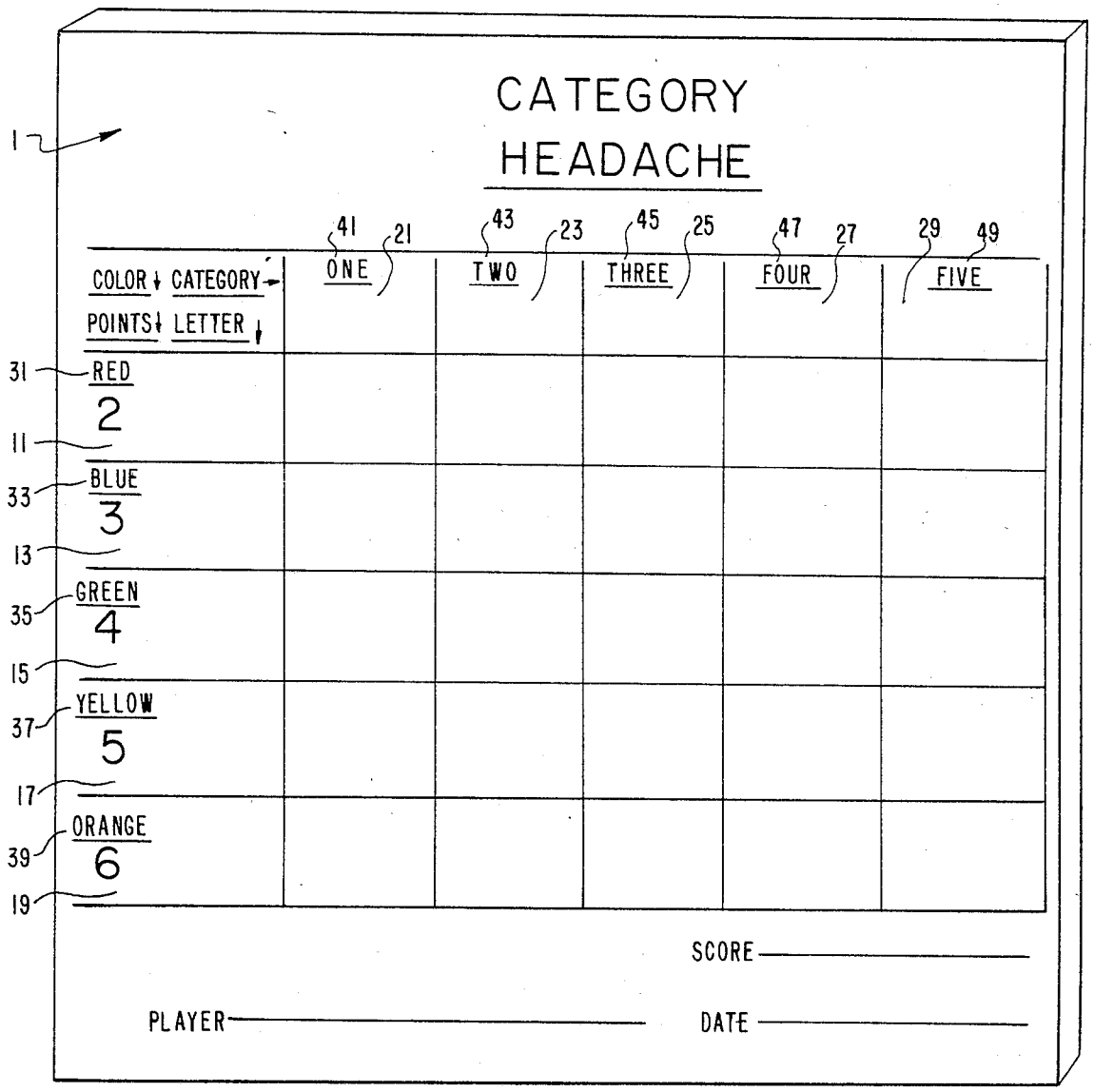
FIG. 1 illustrates an individual playing sheet in the game of the present invention.

The apparatus of the present invention includes a plurality of playing sheets, one of which is shown generally as 1 in FIG. 1. The playing sheets generally have at least 3 horizontal rows and at least 3 vertical columns arranged so as to form a matrix of boxes or sections equal to the number of horizontal rows multiplied by the number of vertical columns. Less than 3 columns and rows makes the game too short and any number of rows and columns may be used, depending upon the duration of game play desired. The number of horizontal rows and the number of vertical columns may be the same or different, and, in one embodiment, are equal. While any number may be used, in general, no more than 10 horizontal rows and 10 vertical columns may be used to avoid impractically lengthy games, preferably no more than 7 of each should be used.

An enjoyable number of rows and columns may be five of each. Thus, as shown in the exemplary playing sheet 1 of FIG. 1, horizontal rows 11, 13, 15, 17 and 19 are shown, as well as vertical columns 21, 23, 25, 27 and 29. Horizontal rows 11, 13, 15, 17 and 19 and vertical columns 21, 23, 25, 27 and 29 have descriptive headings 31, 33, 35, 37, 39, 41, 43, 45, 47 and 49 respectively, as shown. While these descriptive headings contain words, it should be noted that the phrase "descriptive headings" as used herein is meant to include blank heading spaces into which words, numbers, colors and/or symbols may be inserted, as well as spaces already containing any of these. As shown in playing sheet 1, horizontal row descriptive headings 31, 33, 35, 37 and 39 name colors. In the alternative, the colors may be named in the vertical column descriptive headings 41, 43, 45, 47 and 49. Likewise, actual colors, stripes, black or otherwise, could have been used in place of the names of the colors. In any event, it is an essential feature that one set of descriptive headings relate to colors.

Figure 2:
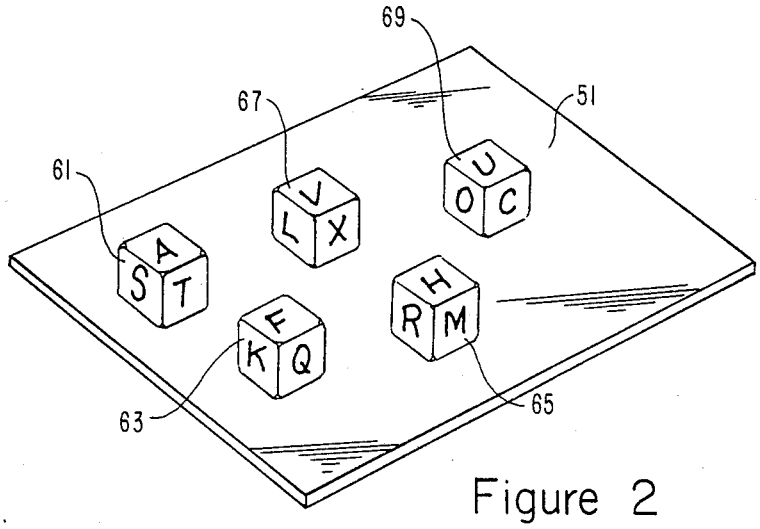
FIG. 2 illustrates colored dice which may be used in the game of the present invention.

Another component of the game apparatus of the present invention are dice. A set of at least 3 dice are used, each having six facets with each facet containing a letter of the alphabet and each of said dice is a different color. The number of dice should correspond to the number of descriptive headings contained on the playing sheet which have colors. Also, the colors of the dice should correspond to the colors of the descriptive headings. Thus, FIG. 2 shows table top 51 (not to scale) having dice 61, 63, 65, 67 and 69. Dice 61, 63, 65, 67 and 69 are red, blue, green, yellow and orange (not shown) to correspond to the colors of descriptive headings 31, 33, 35, 37 and 39 on playing sheet 1 of FIG. 1. The dice shown in FIG. 2 contain a letter of the alphabet on each facet and these letters become inserted in the descriptive headings as shown in FIG. 4 below.

Figure 3:
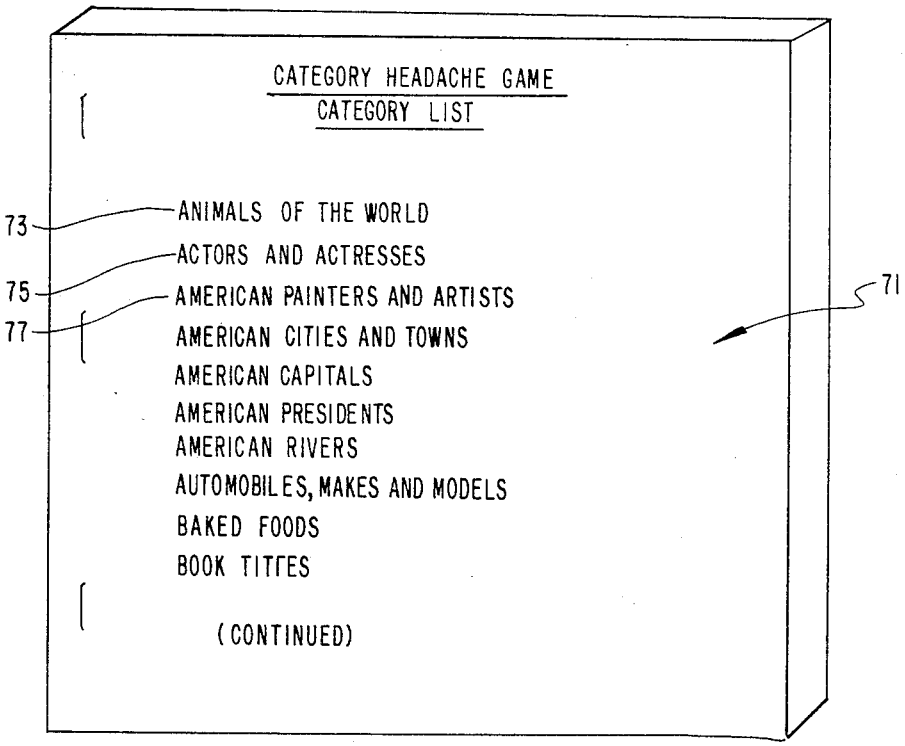
FIG. 3 is a category list which exemplifies the type of category list which may be used in the present invention game.

FIG. 3 illustrates category list 71, here shown in a booklet format. Categories of general information 73, 75, 77, etc. are listed alphabetically. Alternatively, they could be listed by broader subject matter, e.g. history, art, geography, etc. or by difficulty or by age group. Categories are selected by the players or by a director or judge or by chance, as may be desired, and these categories may optionally be coded for chance selection.

The categories of category list 71 of FIG. 3 are selected and inserted in the non-color corresponding descriptive headings; in playing sheet 1, they are inserted into descriptive headings 21, 23, 25 and 27, as shown in FIG. 4. Thus, FIG. 4 illustrates playing sheet 1 of FIG. 1 but as it would appear in use. Also, shown in FIG. 4 are the letters resulting from the dice 61, 63, 65, 67 and 69 of FIG. 2. Some answers 81, 83, 85, 87, 89, etc. are written into the matrix of the playing sheet 1 of FIG. 4, as shown.

Other components of the apparatus of the present invention include marking means to use the playing sheet, means for timing players and instructions. The marking means may be a pencil, pen or other instrument and, in this regard, may even be a computer, in which case the playing sheet will appear as a display on a computer screen. Means for timing may be a timer, a clock, a watch or even an external arbitrary event such as the end of a lunch hour or the time it takes for the first player to complete the matrix in its entirety. The instructions are typically printed, but like the category list and the playing sheets, may take the form of a computer program. In one preferred embodiment, the colors displayed on the individual playing sheets and shown on the dice correspond to varying degrees of difficulty of play and thus represent correspondingly different playing points for purposes of scoring. For example, the FIG. 1 Category playing sheet shows red for 2 points and orange for 6 points. A red die would have the most common letters of the alphabet contained thereon and an orange die would have some of the least common letters of the alphabet contained thereon. This is clearly shown in FIG. 2 with respect to the top facets of each of the dice when taken in conjunction with FIG. 4. Thus, the letter "A" corresponds to 2 points, the letter "F" corresponds to 3 points, and so on with the letter "U" corresponding to 6 points.

The game is played in accordance with the following set of instructions:

(1) One of the players is chosen as a game "Director" who chooses the categories from the category book.

(2) The Director reads categories and players fill them in on their boards, for example, across the top row of numbered categories.

(3) The Director then rolls the "letter" dice. From the roll of the dice, each player inserts the letter on the die, colored to correspond to a colored box on the first vertical row on their boards. For example, letter "A" on red die is inserted on red box on vertical line of boxes on the far left of playing board.

(4) The length of play time is decided by the players and the Director sets timer accordingly.

(5) In the time allotted, each player must fill in as many of the "category-letter" intersecting boxes as possible, with a category word that begins with the letter for that box. For example, the category chosen is animals and the letter is A. The answer could be Aardvark, alligator, asp, etc. or any other animal that begins with the letter "A."

(6) A word is considered "valid" if one other player agrees with a particular player's word choice.

(7) When time buzzes, and the game is up, the director asks each player for his answer in his first "category-letter" box.

(a) If the player's "category-letter" box is blank, he gets no points;

(b) If the player's "category-letter" work is valid but has also been used by another player, he and the other players, who have the same word, each get "one" point;

(c) If the player's "category-letter" word is valid, and he is the only player to use this word, he gets the "bonus" points that are listed in the vertical column for that particular letter.

(8) After hearing each player's words for the his first "category-letter" box and assigning scoring points, the Director asks each player for his words in his second "category-letter" word box, etc.

(9) After all "category-letter" boxes have been done in this fashion and points have been assigned, the player with the most points wins the game.

Obviously, numerous modifications and variations of the present invention are possible in light of the above teachings. For example, the playing sheets mentioned above may be designed or constructed as already mentioned, or may be made of two or more pieces or sections, e.g. may be of a multilayer plastic format. Other changes should now be apparent. It is therefore to be understood that within the scope of the appended claims, the invention may be practiced otherwise than as specifically described herein.

What is claimed is:

1. Apparatus for playing information games, comprising:

(a) a plurality of individual playing sheets having at least 3 horizontal rows and at least 3 vertical columns arranged so as to form a matrix of boxes equal to the number of horizontal rows multiplied by the number of vertical columns, said individual playing sheets further having a set of descriptive headings at the top of each column, and a second set next to each row, at least one set of descriptive headings being related to colors;

(b) a set of at least 3 dice, each having 6 facets with each facet containing a letter of the alphabet, each of said dice being of a different color than the other dice and each such color corresponding to the colors of the descriptive headings of said individual playing sheets;

(c) a list of categories containing general categories of information for game play for insertion into one set of descriptive headings on said individual playing sheets;

(d) means for marking said individual playing sheets including the insertion of categories from said list of categories into one set of descriptive headings on said individual playing sheets and for insertion of letters of the alphabet from said dice into the other set of descriptive headings on said individual playing sheets;

(e) means for timing players playing said information games; and, (f) instructions for playing information games therewith.

2. The apparatus of claim 1 wherein said individual playing sheets has an equal number of vertical columns and horizontal rows.

3. The apparatus of claim 1 wherein said individual playing sheets have at least 5 vertical columns and at least 5 horizontal rows.

4. The apparatus of claim 1 wherein colors on said individual playing sheets and on said dice correspond to varying degrees of difficulty of play and represent correspondingly different playing points for purposes of scoring.

5. The apparatus of claim 1 wherein said individual playing sheets have vertical columns with a set of descriptive headings for insertion of categories and have horizontal rows with descriptive headings with predesignated colors and for insertion of letters of the alphabet from said dice.

6. The apparatus of claim 5 wherein said individual playing sheets have an equal number of vertical columns and horizontal rows.

7. The apparatus of claim 5 wherein said individual playing sheets have at least 5 vertical columns and at least 5 horizontal rows.

8. The apparatus of claim 5 wherein colors on said individual playing sheets and on said dice correspond to varying degrees of difficulty and play and represent correspondingly different playing points for purposes of scoring.

9. An apparatus for playing information games, comprising:

(a) a plurality of individual playing sheets having at least 3 horizontal rows and no more than 7 horizontal rows, and an equal number of vertical columns arranged so as to form a matrix of boxes equal in number to the square of the number of horizontal rows, said individual playing sheets further having a set of descriptive headings at the top of each column, and a second set next to each row, at least one set of descriptive headings being related to colors;

(b) a set of at least 3 dice, each having 6 facets with each facet containing a letter of the alphabet, each of said dice being of a different color than the other dice and each such color corresponding to the colors of the descriptive headings of said individual playing sheets;

(c) a list of categories containing general categories of information for game play for insertion into one set of descriptive headings on said individual playing sheets;

(d) means for marking said individual playing sheets including the insertion of categories from said list of categories into one set of descriptive headings on said individual playing sheets and for insertion of letters of the alphabet from said dice into the other set of descriptive headings on said individual playing sheets;

(e) means for timing players playing said information games; and, (f) instructions for playing information games therewith.

10. The apparatus of claim 9 wherein said individual playing sheets have at least 5 vertical columns and at least 5 horizontal rows.

11. The apparatus of claim 9 wherein colors on said individual playing sheets and on said dice correspond to varying degrees of difficulty of play and represent correspondingly different playing points for purposes of scoring.

12. The apparatus of claim 9 wherein said individual playing sheets have vertical col

* * * * *